United States Patent [19]

Brodie

[11] Patent Number: 4,818,914

[45] Date of Patent: Apr. 4, 1989

[54] HIGH EFFICIENCY LAMP

[75] Inventor: Ivor Brodie, Palo Alto, Calif.

[73] Assignee: SRI International, Menlo Park, Calif.

[21] Appl. No.: 74,979

[22] Filed: Jul. 17, 1987

[51] Int. Cl.[4] ..... G09G 3/10

[52] U.S. Cl. ..... 315/169.3; 315/169.4; 315/169.1; 313/336; 313/351; 340/772

[58] Field of Search ..... 315/169.3, 169.4; 313/336, 500, 351; 340/772

[56] References Cited

U.S. PATENT DOCUMENTS

| | | | |
|---|---|---|---|
| 3,581,148 | 5/1971 | Brignet | 313/336 |
| 3,622,828 | 11/1971 | Zinn | 313/67 |
| 3,665,241 | 5/1972 | Spindt et al. | 313/336 |
| 3,789,471 | 2/1974 | Spindt et al. | 315/169.3 |
| 3,896,327 | 7/1975 | Schermerhorn | 315/169.4 |
| 3,947,716 | 3/1976 | Fraser et al. | 313/336 |
| 3,956,667 | 5/1976 | Veith | 315/169.4 |
| 3,998,678 | 12/1976 | Fukase et al. | 313/336 |
| 4,156,165 | 5/1979 | Fischer | 315/169.4 |
| 4,229,766 | 10/1980 | Sipos | 315/169.4 |
| 4,345,181 | 8/1982 | Shelton | 313/336 |

*Primary Examiner*—Leo H. Boudreau
*Assistant Examiner*—Michael Razavi
*Attorney, Agent, or Firm*—Victor R. Beckman

[57] ABSTRACT

A high efficiency lamp is shown which includes an evacuated envelope, at least a portion of which is light-transmitting. A phosphor layer and anode electrode in engagement therewith is provided at the light-transmitting portion of the envelope. A field emission structure is located inside the envelope, which structure includes spaced plate-like cathode and accelerator electrodes and an insulator separating and insulating the cathode and accelerator electrodes. The accelerator electrode is formed with an array of apertures therethrough, and the cathode electrode is formed with an array of needle-like members projecting from one surface thereof and into the apertures in the accelerator electrode. Electrons are drawn from the tips of the needle-like members by application of a first voltage between the cathode and accelerator electrodes, and emerge from the tips over relatively wide solid overlapping beam angles. The overlapping electron beams are attracted to the anode electrode and impinge upon the phosphor layer for production of light emission from the phosphor. A high dc voltage power supply may be located inside the base of the lamp for energization of the lamp. Alternatively, ac voltages may be supplied to the lamp electrodes for energization thereof. A second accelerator electrode in the form of a ring may be provided adjacent the field emission structure through which electrons pass in travelling from the field emission structure to the anode.

12 Claims, 1 Drawing Sheet

HIGH EFFICIENCY LAMP

TECHNICAL FIELD

Tbis invention relates to a high efficiency lamP and more particularly tc a cathodoluminescent lamp having a field emission cathode.

BACKGROUND OF THE INVENTION

Cathodoluminescent light sources are known as shown in United Kingdom patents, GB No. 2,089,516 published 23 June 1982 and GB No. 2,070,849 published 9 Sept. 1981. These light sources employ thermionic cathodes as an electron source which substantially limits the efficiency of the lamp as well as the operating life thereof. Large-scale cathodoluminescent displays, such as cathode ray tubes, also are known which include a cathodoluminescent layer at the face of the screen and an electron beam from a thermionic cathode. Small-scale cathodoluminescent displays also are known as shown in U.S. Pat. No. 3,855,499, Yamada et al., which display includes a plurality of cathodoluminescent phosphor dots at the display face and a plurality oi field emission cathodes. For each phosphor dot there is an associated cathode such that electrons from only a single cathode impinge upon a phosphor dot. Groups of cathodes are interconnected to provide for the display of line segments at the face of the display. The number of electrons emitted by a single field emission cathode along a relatively narrow beam is limited thereby greatly limiting the brightness of such a display. Also, displays are not intended for general illumination purposes.

An object of this invention is the provision of a high efficiency cathodoluminescent lamp which avoids many of the shortcomings of prior art cathodoluminescent lamps such as described above.

An object of this invention is the provision of an improved cathodoluminescent lamp in which a very large percentage of the electrical input to the lamp is converted to light energy for high efficiency operation.

An object of this invention is the provision of an improved cathodoluminescent lamp of the above-mentioned type which has a long operating life and is inexpensive to manufacture as well as to operate.

The above and other objects and advantages of this invention are achieved by use of an evacuated enveloPe at least a portion of which is light-transmitting. A layer of phosphor and an anode electrode comprising a conducting layer in surface engagement with the phosphor layer are located inside the enveIope at the light transmitting portion thereof. A unitary field emission structure is located inside the envelope opposite the phosphor layer, which structure comprises closely-spaced plate-like cathode and accelerator electrodes with an insulating layer separating the same. These closely-spaced electrodes may be flat or curved, as desired; convexly curved electrodes being used to increase the solid angle at which electrons are emitted from the field emission structure. The accelerator structure is formed with an array of apertures, and the cathode electrode is formed with a corresponding array of needle like members projecting into said apertures. A first voltage source is connected across the cathode and accelerator electrodes for field emission of electrons from tips of the needle-like members toward the phosphor layer. A relatively high voltage may be employed to provide for emission of electrons at a high rate and over a large solid angle from the cathode tips; the larger the voltage the greater the rate of emission and the larger the angle.

A second, higher, voltage source is connected across the cathode and anode electrodes for attraction of electrons from the field emission structure to the phosphor layer for exciting the same to luminescence. To avoid space charge limitation of current within the envelope, an annular accelerating electrode may be included adjacent the field emission structure, which electrode is supplied with the same or lower operating voltage as the anode in surface engagement with the phosphor layer.

The invention will be better understood from the following detailed description considered with the accompanying drawings.

BRIEF DESCRIPTION OF THE DRAWINGS

In the drawings, wherein like reference characters refer to the same parts in the several views.

Figure 1:
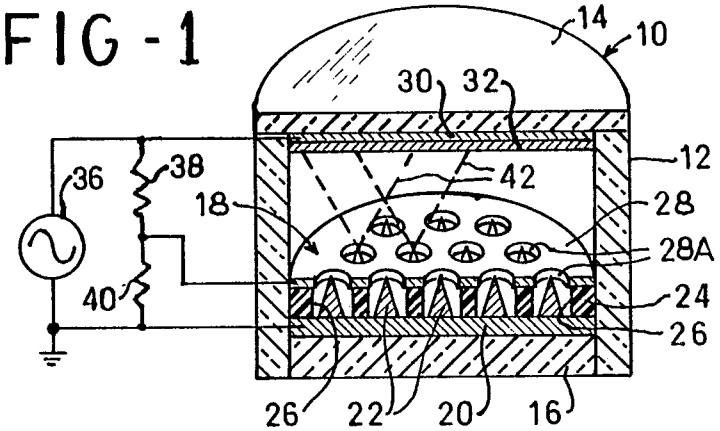
FIG. 1 is a fragmentary perspective view showing a lamp which embodies the present invention.
Figure 2:
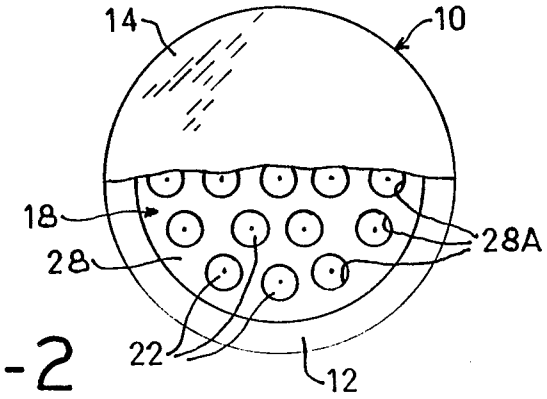
FIG. 2 is a plan view of the lamp shown in FIG. 1 with parts shown broken away for clarity.

Reference first is made to FIGS. 1 and 2 wherein a lamp is shown comprising an evacuated envelope 10. Envelope 10 includes an annular wall 12 of insulating material such as glass, ceramic, or the like, which wall is light-transmitting, or not, as desired. Annular wall 12 is closed at one end by a light-transmitting member 14 and at the other end by a base member, or substrate, 16 upon which a unitary field emission structure 18 is supported. Base member 16 may be made of ceramic, glass, metal, or like material and, for purposes of illustration, a glass me mber is shown. A highly conductive doped silicon layer 20 is deposited on substrate 16 upon which layer an array of individual cathodes 22 is formed. Cathodes 22 comprise one or more needle-like electron emitting protuberances and, for purposes of illustration, each cathode 22 is shown to comprise a single needle-like prot uberance. Protuberances 22 may be formed of a refractory metal such as molybdenum or tungsten.

A dielectric film 24, such as a film of silicon dioxide, is deposited over the surface of silicon layer 20, which film is provided with an array of apertures 26 through which the emitter electrode protuberances 22 extend. A unitary accelerator electrode 28 is iormed as by depositing a metal layer on the dielectric film 24 Preferably, the upper tips of the cathode Protuberances 22 terminate at a level intermediate the upper and lower surfaces of the accelerator electrode 28 substantially at the center of the apertures 28A in the electrode for maximizing the electric field at the tips under field emission operation of the cathode.

Field emission cathode structures oi the abovedescribed type are well known in the prior art and a method of producing the same is shown, for examPle, in U.S. Pat. No. 3,789,471 by C.A. Spindt et al. It here will be understood that various dimensions of the field emission cathode structure may be very small. For example, with current fabrication methods the thickness of dielectric film 24 and accelerator electrode 28 may be on the order of 1.5μm and 0.5μm, respectively, and the diameter of apertures 28A may be less than 1 μm. Protuberances 20 may be closely spaced, with up to 2×108 protuberances/cm$^2$ being formed on the substrate. For use in the present invention, the field emission cathode structure preferably includes at least $10^6$ protuberances/cm$^2$. From the above, it will be apparent the field emission cathode structure is depicted on a greatly enlarged scale in the drawings.

A unitary anode electrode 30 is deposited on the inside surface of the light-transmitting end member 14 opposite the cathode structure, which anode electrode is made oi a light-transmitting, conducting material such as tin oxide, indium oxide, or the like. A phosphor layer 32 is formed on the surface of anode electrode 30, which phosphor emits light energy under impact of electrons emitted from protuberances 20 of the cathode structure. Luminescence emission from the phosphor layer passes through transparent anode electrode 30 and light transmitting end member 14 of the evacuated envelope.

The lamp shown in FIGS. 1 and 2 is well adapted for operation at relatively low voltages and, consequently, with a relatively low light output. 1f desired, the lamp may be operated from a standard 120 volt a.c. source 36, one terminal of which is connected to silicon layer 20 upon which the cathode protuberances 22 are formed. The other terminal is shown directly connected to the transparent anode electrode 30, and to the accelerating electrode 28 through a voltage dividing neiwork comprising series-connected resistors 38 and 40. The resistance values of the voltage dividing resistors 38 and-40 are selected to assure that the peak cathodeaccelerator voltage exceeds the voltage required for field emission. Field emission structures wherein field emission occurs with a cathode-accelerator electrode potential of as low as 50 volts are known. Therefore, it will be apparent that the lamp may be operated using a conventional 120v ac source. By using the standard 120v source, no separate power supply is required for operation of the lamp. Of course only when the accelerator and anode electrodes are sufficiently positive with respect to the cathode structure during the alternating current cycle are electrons emitted from the tips of Protuberances 22 for field emission of electrons irom the cathode and impingement upon phosphor layer 32.

With the present invention, electrons are emitted from the tips of the cathode protuberances 22 over a wide solid angle such that the electron beams from individual protuberances overlap at the phosphor layer. In FIG. 1, wide solid angle electron beams from several field emitter tips are shown and identified by reference numeral 42. By using wide angle, over-lapping, electron beams, relatively uniform light emission is provided at the face of the lamp. With applicant's lamp, power dissipated by electrons striking the phosphor layer is spread over a large area which allows for increased light output as compared, for example, to arrangements wherein the electrons are beamed onto small areas for display purposes. The illustrated lamp, with the relatively low voltage power supply, is best adapted for use as a signal light, or the like, rather than for general illumination. Of course, operation at substantially larger voltages, and with direct current, is possible, in which case the light output from the lamp would be substantially greater.

Figure 3:
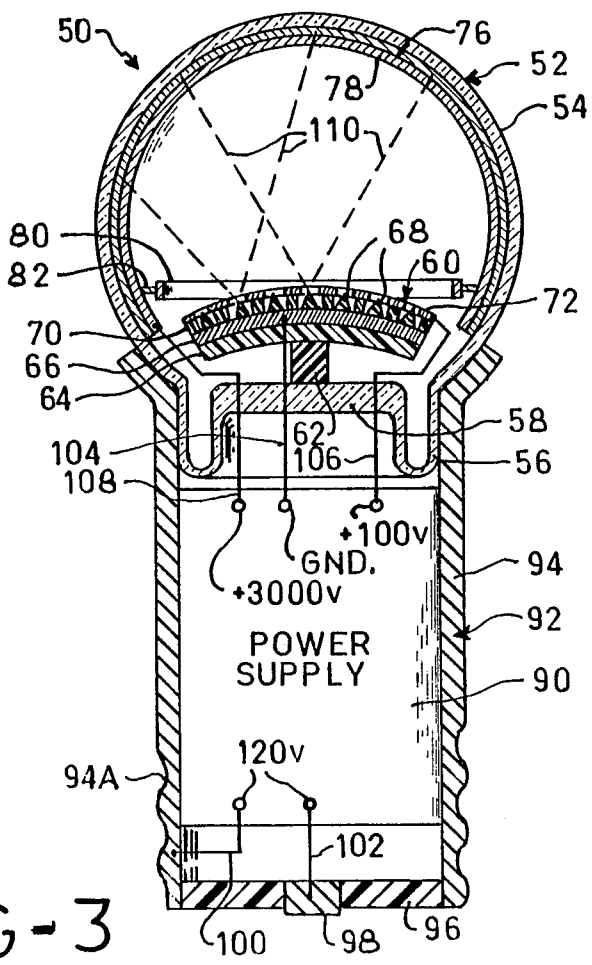
FIG. 3 is a fragmentary elevational view with parts shown broken away of another lamp embodying the present invention, which lamp includes a high voltage power supply in the base thereof.

Reference now is made to FIG. 3 wherein a high voltage, high intensity, lamp 50 is shown comprising an evacuated envelope 52 which includes an enlarged generally spherical shaped portion 54 and an integral generally cylindrical shaped neck portion 56. The neck includes a reentrant stem portion which is closed at the inner end by end wall 58. A field emission structure 60 is mounted inside the envelope at end wall 58 as by supporting means 62.

Field emission structure 60 is substantially of the same type as field emission structure 18 shown in FIGS. 1 and 2 and described above. However, structure 60 differs in that the electron emitting surface is convexly curved rather than planar whereby electrons produced thereby are emitted over a wider beam angle than a comparable-sized planar structure operating at the same voltage. Field emitter structure 60 is seen to include a base member 64, a conducting silicon layer 66 deposited thereon, an array of individual cathodes 68 on silicon layer 66, a dielectric film 70 on silicon layer 66 formed with an array of apertures through which the cathodes 68 extend, and an accelerating electrode 72 also formed with an array of apertures into which tips of the cathodes 68 extend.

The interior wall of bulb portion 54 of envelope 52 is provided with a unitary phosphor layer 76, which phosphor layer is coated with a conducting material 78 comprising a unitary anode electrode. Anode electrode 78 may comprise, for example, a thin aluminum layer which is readily penetrated by electrons from field emitter structure 60, which electrons then impinge upon the phosphor layer 76 for emission of light energy. Aluminum layer 78 not only functions as an anode for collection of electrons from the field emitter structure 60, but also serves to reflect light from the phosphor layer 76 to minimize light loss.

For purposes of illustration, and not by way of limitation, the lamp is provided with a second accelerating electrode 80 of annular shape supported by arms 82 extending between the electrode and the envelope 52. In the il lustrated arrangement the arms electrically connect the annular electrode 80 to the anode 78 whereby the electrode and anode operate at the same potential. A strong electric field is provided between the accelerating electrode 72 oi the field emission structure 60 and the annular electrode 80 which serves to spread the beam and to prevent space charge inside the envelope from repelling emitted electrons and causing them to return to electrode 72.

Operation of the lamp at relatively high voltages is desirable to facilitate penetration of anode layer 78 by the electrons. To this end, a high voltage power supply 90 is built into base 92 of the lamp. Base 92 comprises a cylindrical metallic member 94 which flares outwardly at one end for attachment to the bulb portion of envelope 52 as by cementing, or the like. Neck portion 56 of the envelope extends into one end of cylinde 94, and power supply 90 is mounted inside the cylinder adjacent the opposite end. The outer end of cylinder 94 is closed by an insulating ring 96 and an end contact 98 at the center of the ring. Also, cylinder 94 may be provided with a threaded end 94A for use with conventional type sockets employed in general lighting fixtures. Wires 100 and 102 connect the cylinder 94 and contact 98 to the input terminals of power supply 90 for connection of the power supply to a power source, such as a conventional 120 volt ac source, through cylinder 94 and contact 98.

The power supply output includes ground, +lOOv, and +3,000v output terminals which are connected through leads 104, 106 and 108 to the cathodes 68 through silicon layer 66, the accelerator electrode 72, and the anode electrode 78, respectively. As noted above, annular accelerator electrode 80 is electrically connected to anode 78 whereby they are maintained at the same +3,000 voIt potential. Obviously, the above-mentioned voltages are for purposes of illustration only, the lamp being operable over a relatively wide range of voltages. Maximum operating voltages are limited by the power density dissipated by the electrons at the wall which raises the temperature at which the lamp is operated. The operating temperature is limited to that below which outgassing of the phosphor anode Iayer, and enveIope occurs. As noted hereInbeIow, the luminous efficiency of the lamps is very high whereby operation at relatively low temperatures is possible. As no(ed above, relatively high annular accelerator electrode 80 and anode electrode 78 voltages are desired for attraction of electrons from the field emission device 60 and penetration thereof through the anode and onto the phosphor layer 76.

Wide solid angle electron beam patterns from two of the cathode tips are shown and identified by reference numeral 110. With the same voltage applied to both the annular accelerator electrode 80 and anode electrode 78, zero electric field is provided therebetween whereby electrons drift to the anode electrode once they are accelerated beyond the annular accelerator electrode. Obviously, the anode and annular accelerator electrodes may be supplied with different voltages to provide for an electric field and acceIeraiion of electrons therebetween. For example only, annular electrode 80 may be connected to a +2,000 volt source and the anode 78 to a +3,000 volt source.

High voltage power supplies 90 for use in the present invention are well known and require no detailed description. They include solid-state components such as resistors, rectifiers, and the like. With prior art cathodoluminescent lamps utilizing thermal emission sources and integral power supplies, a large amount of heat is generated which greatly increases the operating temperature of the power supply components. Since electrical characteristics of such components is adversely affected by excessive temperature, means must be provided to avoid overheating of the power supply. With the present invention, substantially less heat is generated by operation of the lamp than with a conventional incandescent lamp with the same light output. Additionally, production of electrons by use of field emission cathodes also is highly efficient, thereby providi ng a source of ele ct rons with substantially no heat losses. Consequently, less precautions are required to avoid overheating of power supply 90 located in the base of the lamp since a minimum of heat is generated by operation of the lamp.

The field emission cathode employed in the present lamps responds immediately to application of operatiqg voltages to provide for substantially instant-on operation of the lamp. Also, field emission cathodes of the illustrated type have a long operating life to provide the lamps with a long life, on the order of 100,000 hours.

The invention having been described in accordance with requirements of the Patent Statutes, various other changes and modifications will suggest themselves to those skilled in this art. Many different inorganic lu minescent materials are known which produce illumination of different colors, which phosphors may be used in the present lamps. Also, electrically conducting phosphors may be employed in which case ihe phosphor layer also comprises the anode electrode thereby avoiding the requirement for a separate anode layer. Similarly, if the phosphor employed is not naturally conductive, it may be admixed with conductive material to render the same conductive. As noted in the illustrated embodiments of the lamp, the separate anode electrode, when employed, may be located at either surface of (he phosphor layer, so long as it is light-surface transmitting if located between the phosphor and light-transmitting envelope, and is readily penetrable by electrons from the field emission structure when located inside the phosphor layer. As noted above, for a high-voltage, high-intensity lamp, a phosphor layer on the inside surface of the evacuated envelope together with a conductive coating applied io ihe phosphor layer is desirable for reflecting light from the phosphor. It is intended that the above and other such changes and modifications shall fall within the spirit and scope of the invention defined in the appended claims.

I claim:

1. A cathodoluminescent lamp comprising:

an evacuated envelope at least a portion of which is light-transmitting, a field emission structure inside said envelope comprising spaced plate-like cathode and accelerator electrodes and an insulator separating and insulating the cathode and accelerator electrodes, said accelerator electrode comprising a unitary conduct or f ormed with an array of apertures therethrough, said cathode electrode being formed with an array of needle-like members projecting from one surface thereof and into said apertures in said unitary accelerator electrode, means for supplying a first voltage across the cathode and accelerator electrodes for field emission of electrons from tips of the needle-like members into said evacuated envelope, electrons from each needle-like member being emitted over a solid beam angle whereby electron beams overlap within the envelope, a layer of phosphor at the light-transmitting portion of the envelope, an anode electrode at the phosphor layer, and means for supplying a second voltage greater than said first volta8e across the cathode and anode electrodes for collecting the overlapping electron beams emitted from the field emission structure, electrons collected by said anode electrode impinging on said phosphor layer ior exciting the phosphor layer to luminescence.

2. A cathodoluminescent lamp as defined in claim 1 wherein electrons impinging on said phosphor layer are substantially uniformly distributed for substantially uniform illumination over the excited phosphor layer.

3. A cathodoluminescent lamp as defined in claim 1 wherein said field emission structure is convexly curved to provide for an extended angle of electron emission from the field emission structure.

4. A cathodoluminescent lamp as defined in claim 1 including a lamp base attached to the evacuated envelope, a high voltage power supply inside said base and providing cathode, anode and accelerator electrode operating voltages, and means for connecting the cathode, anode, and accelerator electrode operating voltages from said power supply to said cathode, anode, and accelerator electrodes, respectively.

5. A cathodoluminescent lamp as defined in claim 4 wherein said operating voltages are dc voltages.

6. A cathodoluminescent lamp as defined in claim 4 wherein said phosphor layer is deposited on the interior surface of the envelope, and said anode electrode comprises a light-reflecting conductive layer deposited on said phosphor layer through which electrons from said field emission structure pass for impingement on the phosphor layer.

7. A cathodoluminescent lamp as defined in claim 1 including means for connecting said cathode and anode electrodes across an ac voltage source, and voltage reducing means for connecting the accelerator electrode to said ac voltage source.

8. A cathodoluminescent lamp as defined in claim 7 wherein the ac voltage source comprises a household 120v ac source.

9. A cathodoluminescent lamp as defined in claim 1 wherein said anode electrode comprises a lighttransmitting conductive layer deposited on the interior surface of the envelope, and said phosphor layer is deposited on said anode electrode.

10. A cathodoluminescent lamp as defined in claim 1 wherein said cathode electrode is iormed with at least $10^6$ needle-like members/$cm^2$ irom the tips of which members electrons are emitted.

11. A cathodoluminescent lamp as defined in claim 1 including an annular accelerator electrode adjacent the field emission structure through which electrons pass in travel irom the iield emission structure to said anode electrode.

12. A cathodoluminescent lamp as defined in claim 11 including means for electrically interconnecting the annular accelerator electrode and anode electrode so that they are at the same potential for production of a zero electric fIeId therebetween.

* * * * *